US006651857B1

(12) United States Patent
Tsai

(10) Patent No.: US 6,651,857 B1
(45) **Date of Patent: *Nov. 25, 2003**

(54) COMBINATORIAL MULTI-USE TAPE DISPENSER

(76) Inventor: Ching Tsung Tsai, 364, Sec. 2, Mei Liao, Rd, Chu In Li, Ho Mei, Chang Hua (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/574,214

(22) Filed: May 19, 2000

(51) Int. Cl.[7] ..... B65H 35/07; A45C 11/34

(52) U.S. Cl. ..... 225/42; 225/26; 225/43; 225/47; 225/77; 206/214; 220/833; 242/588.6; 242/598.5

(58) Field of Search ..... 225/25, 26, 39, 225/43, 46, 47, 77, 40, 41, 42, 50, 53, 90; 220/4.22, 4.23, 810, 833, 836; 224/315; 206/214, 224, 225, 340, 341, 371, 575; 242/588, 588.3, 588.6, 598.3, 598.5

(56) References Cited

U.S. PATENT DOCUMENTS

| | | | | | |
|---|---|---|---|---|---|
| 1,787,881 | A | * | 1/1931 | Uttz, Sr. | 225/46 X |
| 2,305,592 | A | * | 12/1942 | Anderson | 225/25 X |
| RE23,129 | E | * | 6/1949 | Borden | 225/25 |
| 2,924,365 | A | * | 2/1960 | Dahlquist | 225/47 |
| 3,915,362 | A | * | 10/1975 | Hart | 224/328 |
| 3,930,697 | A | * | 1/1976 | Barouh et al. | 206/225 X |
| 4,186,833 | A | * | 2/1980 | Homan | 206/225 |
| 4,406,387 | A | * | 9/1983 | Rasor | 220/4.22 X |
| 4,738,384 | A | * | 4/1988 | Tigner | 225/43 X |
| 5,160,077 | A | * | 11/1992 | Sticklin | 225/47 X |
| 5,894,922 | A | * | 4/1999 | Miller et al. | 206/214 |
| 6,311,923 | B1 | * | 11/2001 | Tsai | 242/598.5 |
| 6,371,403 | B1 | * | 4/2002 | Shen | 225/47 X |

* cited by examiner

*Primary Examiner*—Clark F. Dexter
(74) *Attorney, Agent, or Firm*—Troxell Law Office PLLC

(57) ABSTRACT

A multi-use tape dispenser includes a housing with an open upper side, and a tape dispenser body pivotally connected to the housing to swing up and down on the housing. Small stationery items can be stored in a hollow space in the housing and may be taken out for use when the tape dispenser is swung up. The bottom of the housing has four suction discs to secure the tape dispenser on a table.

6 Claims, 6 Drawing Sheets

COMBINATORIAL MULTI-USE TAPE DISPENSER

BACKGROUND OF THE INVENTION

The invention relates to a combinatorial multi-use tape dispenser, particularly to one having various uses for containing small stationery items, not taking much space of a table surface.

A tape dispenser and a stationery case are common utensils in offices, placed on a table for ready use. A table surface for each employee may be often limited and there is not enough space for placing various kinds of office utensils.

A known conventional tape dispenser 1 shown in FIG. 1 has an intermediate hollow space for placing a tape 2, which is pulled out from the dispenser 1 for use. To prevent the dispenser 1 from moving forward when pulling the tape 2, the bottom of the dispenser 1 has a hollow space 3 preset for filling in something like sand 4 to make the dispenser 1 heavy so as not to be moved with the tape 2 that is pulled out. The bottom of the dispenser 1 is provided with two holes 5 to communicate with the hollow space 3 for filling in sand 4 therein and then sealed with seal pads 6 to prevent sand 4 from leaking out. But this kind of manufacturing process is complicated and not convenient. In pulling out the tape 2, the dispenser 1 is often also pulled forward together if the pulling force is too large and surpasses the weight of the dispenser 1. Then a hand has to be used to hold the dispenser 1. In addition, the seal pads 6 are made of foam material and are subject to wear off causing the sand 4 to leak out.

SUMMARY OF THE INVENTION

The purpose of the invention is to offer a combinatorial multi-use tape dispenser having a tape dispenser body placed on a housing and a hollow space formed in the housing for containing small stationery items therein, saving needed space for them on a table surface.

The invention includes a housing, a tape dispenser body pivotally connected to the housing to swing up and down on the housing, and plural suction discs. The housing has an upper open side and a hollow rectangular space and preferably separated compartments formed in the hollow space for placing small stationery items such as clips, pin, rubber erasers, a paper knife, pens, etc. The tape dispenser body is swung up to expose the small stationery items enabling them to be taken out.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
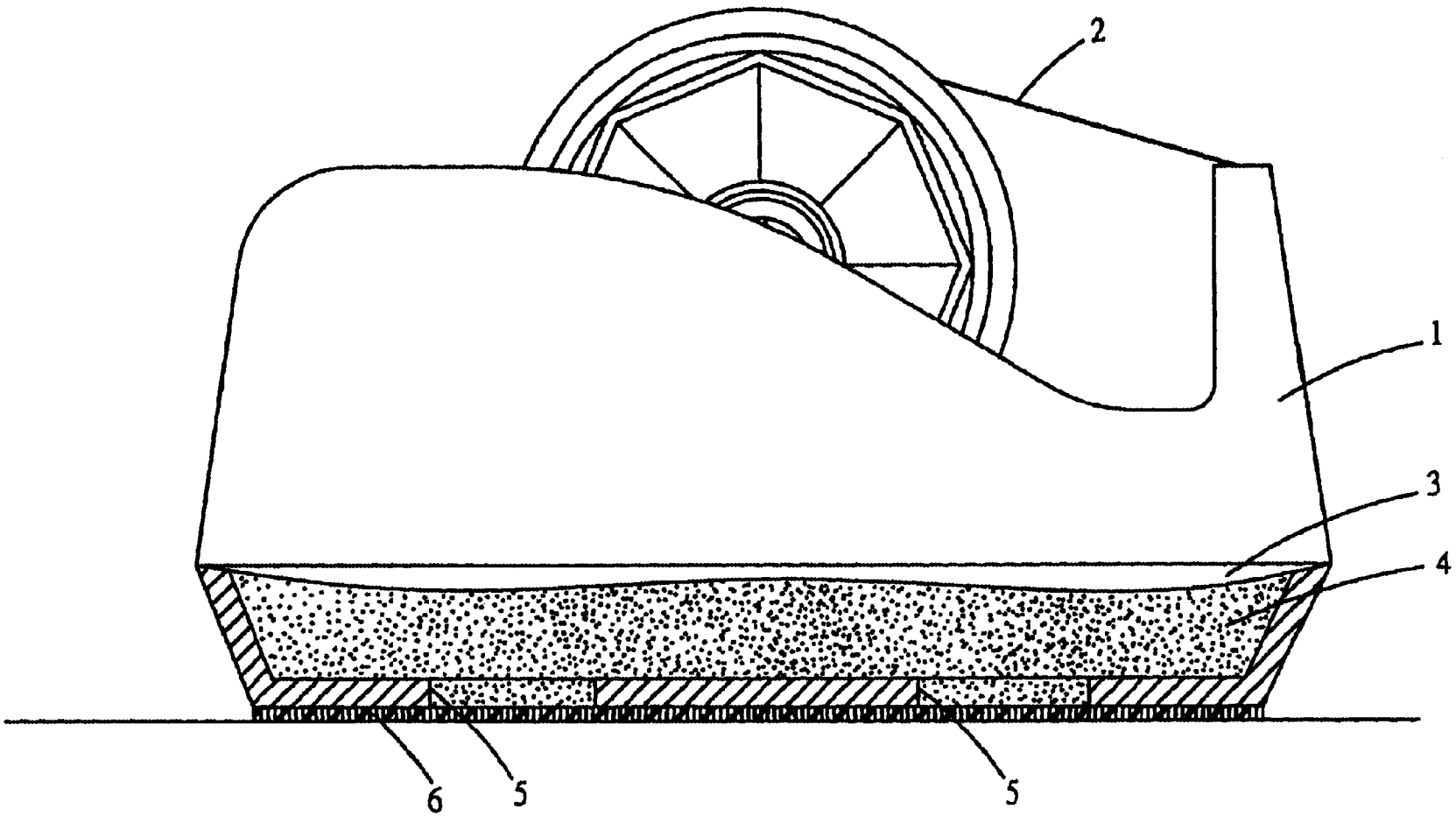
FIG. 1 (PRIOR ART)
FIG. 1 is a cross-sectional view of a known conventional tape dispenser.
Figure 2:
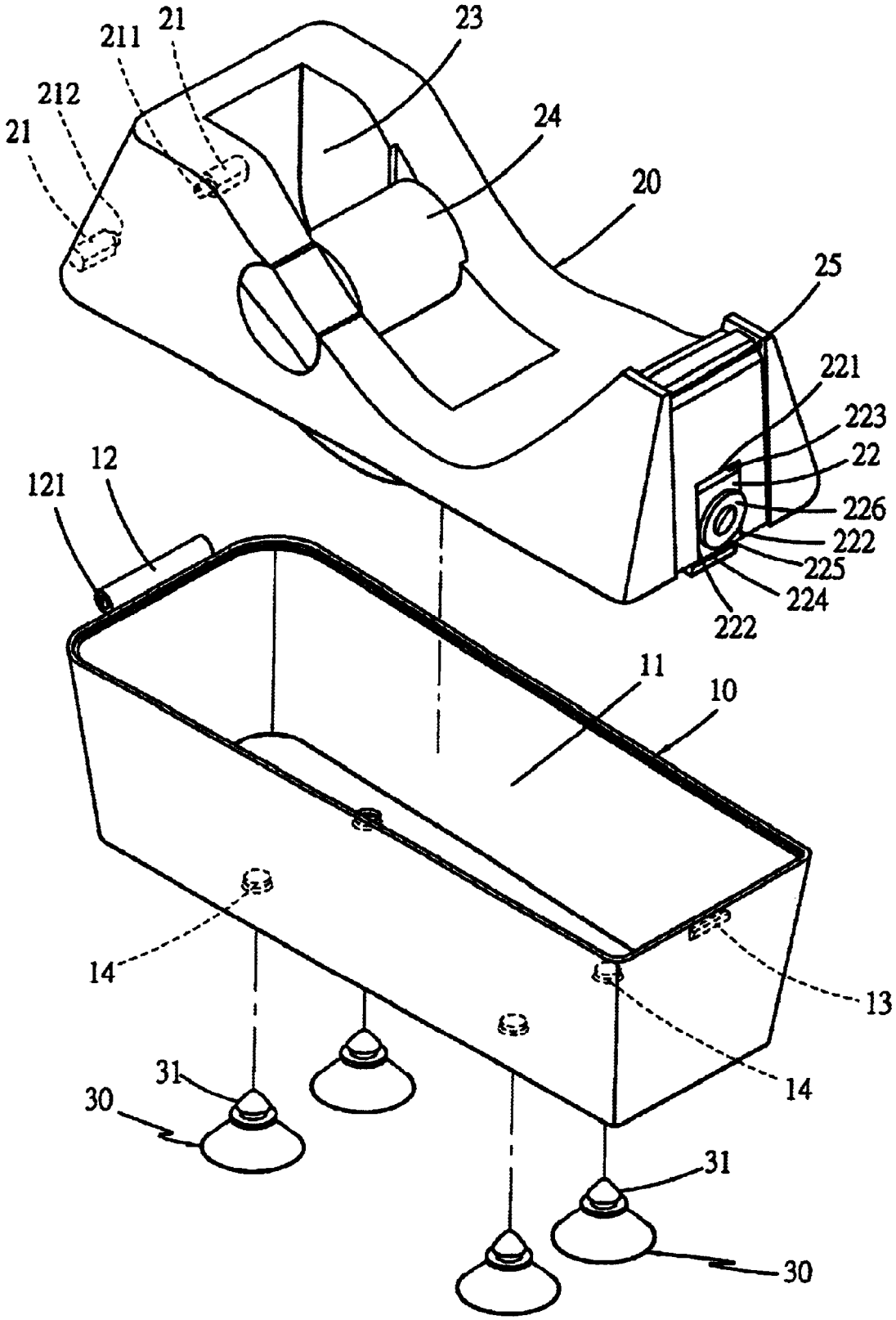
FIG. 2 is an exploded perspective view of a combinatorial multi-use tape dispenser in the present invention.
Figure 3:
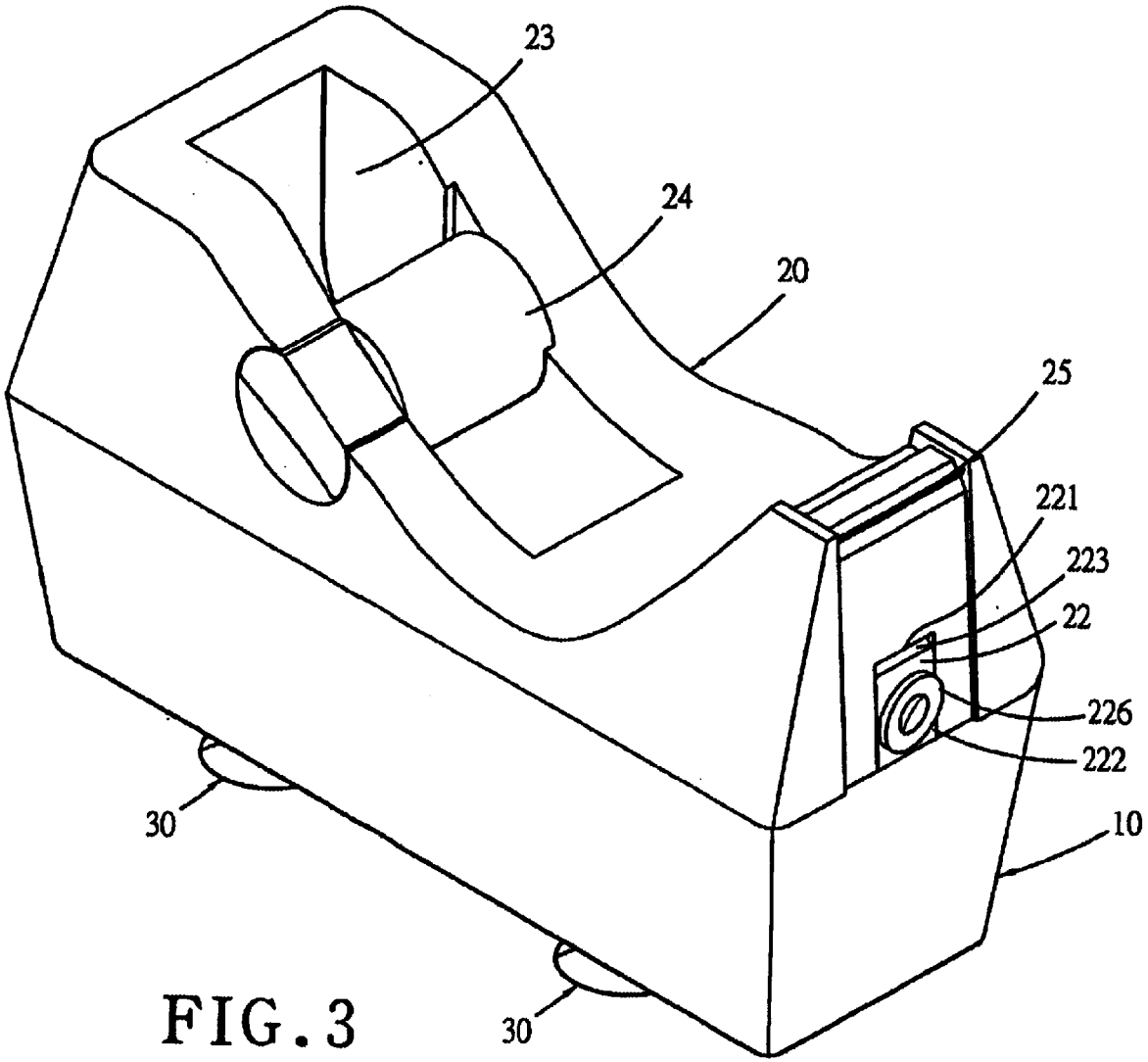
FIG. 3 is a perspective view of the combinatorial multi-use tape dispenser in the present invention.

A preferred embodiment of a combinatory multi-use tape dispenser in the present invention, as shown in FIGS. 2 and 3, includes a housing 10 with an open upper side, a tape dispenser body 20, and four suction discs 30 as main components combined together.

The housing 10 is a hollow and rectangular body with an open upper side, having a substantial hollow space 11, a pivot sleeve 12 fixed on an upper edge of a left side and having a pivot hole 121, an engagement groove 13 formed in an upper edge of a right side, and two pairs of two aligned holes 14 formed tapered in the bottom wall for the four suction discs 30. The tape dispenser body 20 is pivotally connected to the housing 10, having two pivot bases 21 on an outer surface of a left side, each pivot base 21 having round pivots 211 (long), 212 (short) extending straight from an inside end. The long pivot 211 fits in the pivot hole 121 of the pivot sleeve 12, and the short pivot 212 in the other pivot hole 121 of the pivot sleeve 12 when the tape dispenser body 20 is pivotally connected with the housing 10. Further, the tape dispenser body 20 has a press engagement member 22 formed integral in a front side. The press engagement member 22 has an upper horizontal edge 221 connected to the tape dispenser body 20, and two sides 222 completely separated from the tape dispenser body 20, so that the press engagement member 22 may be pressed to swing with the upper edge 221 as a fulcrum. In addition, a recess 223 is formed adjacent the upper edge 221 of the press engagement member 22 to permit the press engagement member 22 to elastically recover its position after being pressed. The press engagement member 22 further has a protrusion 224 formed in the bottom thereof, and a recess 225 formed adjacent the protrusion to let the protrusion 224 engage the engagement groove 13 of the housing 10. The press engagement member 22 further has a press button 226 formed on an outer surface for pressing the press engagement member 22. The tape dispenser body 20 has a lengthwise hollow 23 formed in an intermediate portion thereof that is defined by two side sloped surfaces. A tape shaft 24 in an upper exterior surface, more specifically is movably fitted laterally in the lengthwise hollow 23 for a tape 40 to be movably mounted. Further, a saw-toothed blade 25 is fixed on an outer edge of a front wall of the tape dispenser body 20 to cut the tape 40.

The four suction discs 30 respectively have an upper portion 31 of a cone-shape to fit smoothly and tightly in the holes 14 of the housing 20, securing the tape dispenser on a table surface 50 by suction.

Figure 4:
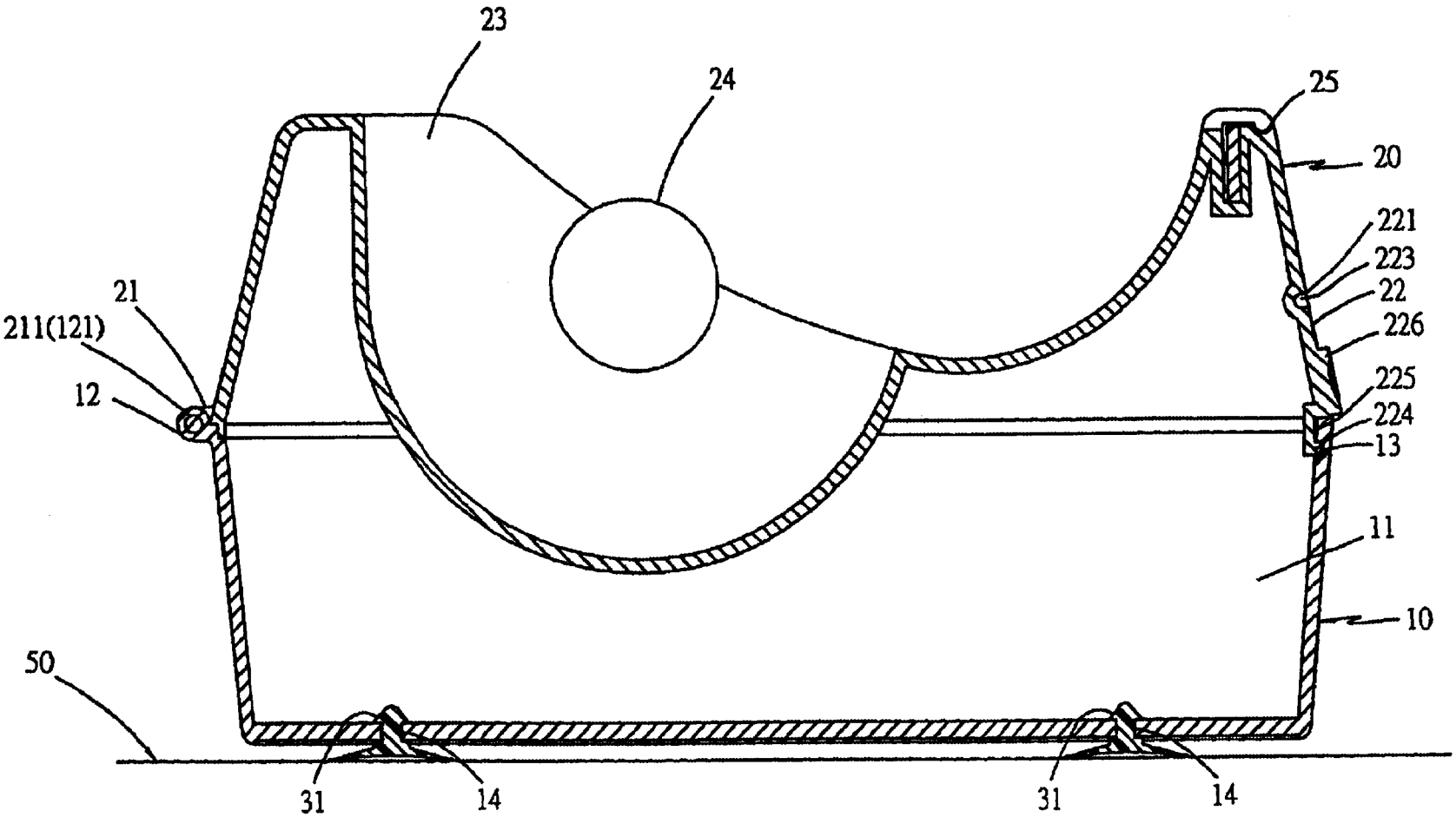
FIG. 4 is a cross-sectional view of the combinatorial multi-use tape dispenser in the present invention.
Figure 5:
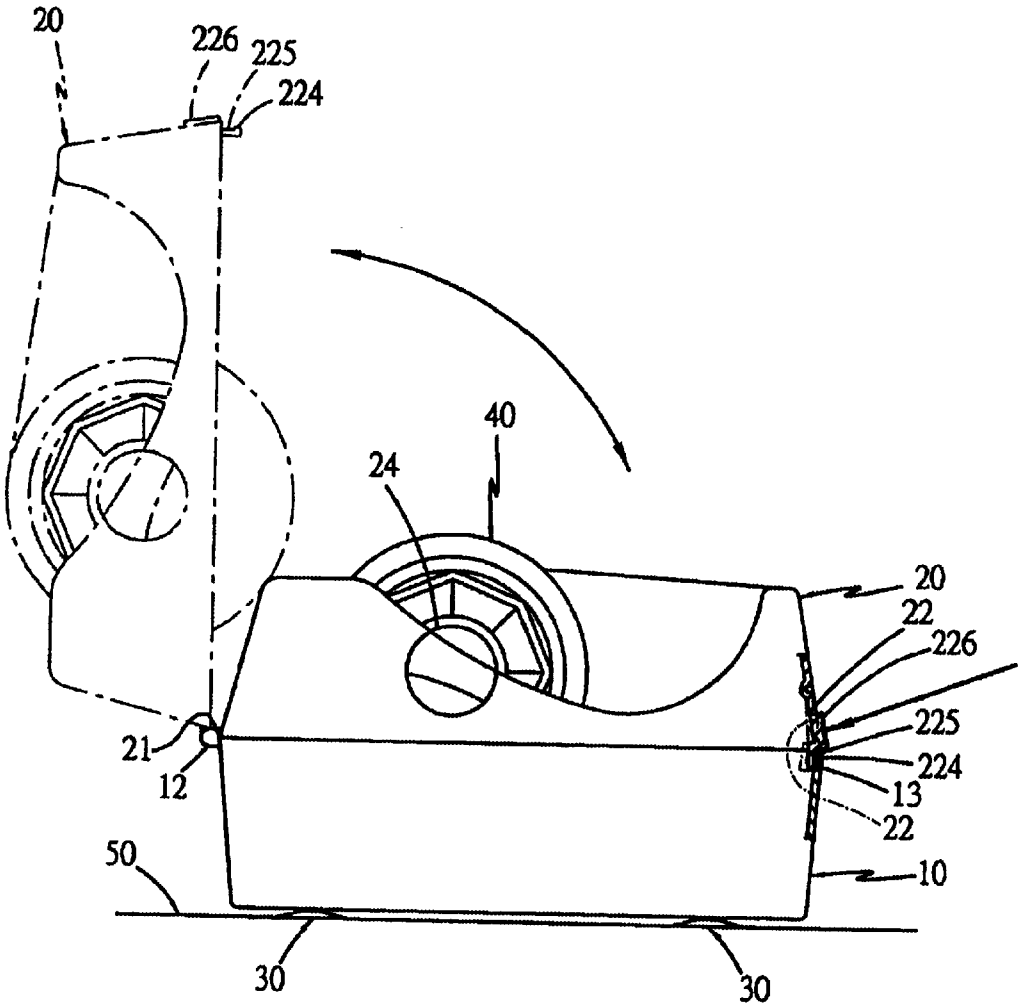
FIG. 5 is a side view of the combinatorial multi-use tape dispenser with the tape dispenser body swung up and leftward in the present invention; and, FIG. 6 is an exploded perspective view of the combinatorial multi-use tape dispenser added with a lengthwise separating plate and plural lateral separating plates on the bottom of the housing in the present invention.

In use, as shown in FIG. 4, the tape dispenser is placed on a table surface 40, letting the four suction discs 30 engage the table surface 40 and be pressed down to cause the air therein to flow out. The tape dispenser body 20 is pivotally connected to the housing 10 and locked with the press engagement member 22. If articles, such as clips contained in the lower portion of the hollow space 11 are to be used, the press button 226 is pushed, forcing the protrusion 224 to disengage from the engagement groove 13 of the housing 10. Then, the press button 226 is swung upward along with the tape dispenser body 20 about the two pivots 211, 212 to expose the hollow space 11. If the tape dispenser body 20 is to be closed, the tape dispenser body 20 is swung down so the protrusion 224 of the press engagement member 22 may engage the engagement groove 13 of the housing 10 to secure the tape dispenser body 20 with the housing 10.

Figure 6:
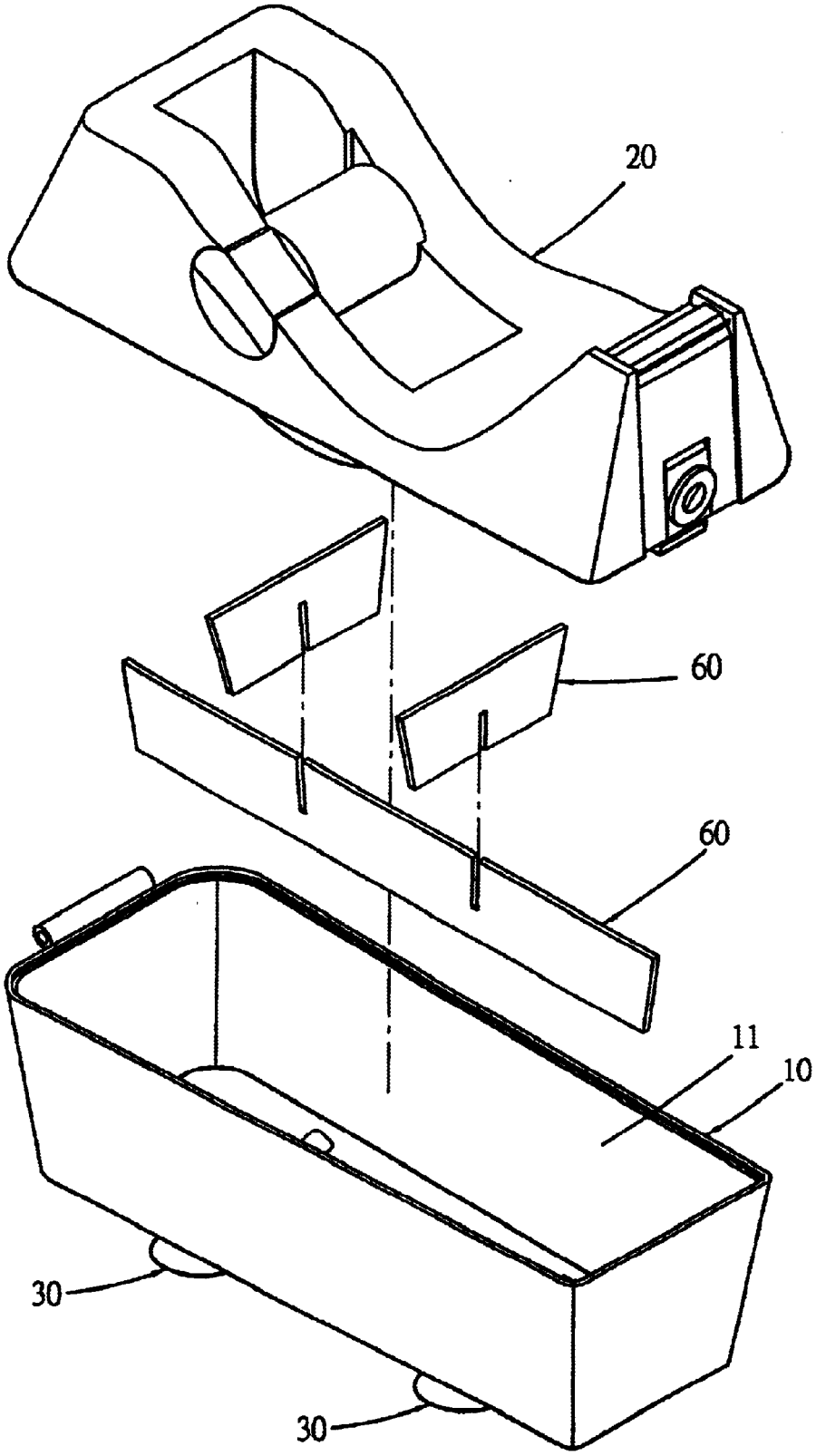

In addition, as shown in FIG. 6, a preset number of longitudinal and lateral separating plates 60 may be added in the lower portion of the hollow space 11, defining a plurality of small compartments to store various small stationery items therein.

The invention has the following advantages as can be understood from the aforesaid description.

1. It can contain various small stationery items such as pens, clips, pins, etc., for use, aside from the tape dispenser, saving space on a table surface.

2. It has four suction discs to secure the tape dispenser on a table, and so it may not move when the tape is pulled out for use, and requires no sand to increase its weight. It is lighter than conventional dispensers, convenient to carry, and subsequently can save cost for transportation. Since it does not use sand, it is simpler to assemble, and will not soil the table surface.

While the preferred embodiment of the invention has been described above, it will be recognized and understood that various modifications may be made therein and the appended claims are intended to cover all such modifications that may fall within the spirit and scope of the invention.

What is claimed is:

1. A multi-use tape dispenser comprising:

a) a housing having side walls and a bottom bounding a hollow interior space, and including a pivot sleeve located adjacent to an upper edge of one of the side walls;

b) a plurality of suction discs mounted on the bottom of the housing to attach the housing to a surface;

c) a tape dispenser body having a lengthwise hollow formed in an exterior upper surface of the tape dispenser body, a tape shaft mounted on the tape dispenser body and extending across the lengthwise hollow, and a tape cutting blade mounted on the tape dispenser body, the tape dispenser body being pivotally connected to the pivot sleeve of the housing so as to be movable between a closed position, wherein a lower portion of the tape dispenser body rests on the side walls of the housing so as to cover the hollow interior, and an open position wherein the tape dispenser body is displaced from the sidewalls so as to expose the hollow interior of the housing; and, d) a latching mechanism to releasably latch the tape dispenser body to the housing in the closed position, the latching mechanism including: an engagement member movably connected to the tape dispenser body and having a protrusion; and an engagement groove on the housing releasably engaged by the protrusion when the tape dispenser body is in the closed position, whereby movement of the engagement member disengages the protrusion from the engagement groove enabling the tape dispenser body to be moved to the open position.

2. The multi-use tape dispenser of claim 1 wherein the engagement member is formed integrally with the tape dispenser body.

3. The multi-use tape dispenser of claim 2 further comprising a recess formed in the engagement member adjacent the tape dispenser body.

4. The multi-use tape dispenser of claim 1 further comprising:

a) a pivot hole in the pivot sleeve; and b) first and second pivot bases on the tape dispenser body, each pivot base having a pivot axle extending therefrom and pivotally engaging the pivot hole.

5. The multi-use tape dispenser of claim 4 wherein the pivot axles extending from the pivot bases have different lengths.

6. The multi-use tape dispenser of claim 1 further comprising a press button on the engagement member.

* * * * *